United States Patent [19]

Valencia Aguilar

[11] 4,266,379

[45] May 12, 1981

[54] ASEISMIC SYSTEM FOR STRUCTURE FOUNDATION

[76] Inventor: Hector Valencia Aguilar, Cerro Gordo No. 44, Col. Campestre-Churubusco, Mexico 21, D.F., Mexico

[21] Appl. No.: 17,860

[22] Filed: Mar. 6, 1979

[51] Int. Cl.[3] ..... E04H 9/00

[52] U.S. Cl. ..... 52/1; 52/167

[58] Field of Search ..... 52/167, 1, 126, 396

[56] References Cited

U.S. PATENT DOCUMENTS

| | | | |
|---|---|---|---|
| 3,232,015 | 2/1966 | Latham | 52/167 |
| 3,748,800 | 7/1973 | Glicksberg | 52/167 |
| 3,986,367 | 10/1976 | Kalpins | 52/167 |

*Primary Examiner*—Price C. Faw, Jr.
*Assistant Examiner*—Carl D. Friedman
*Attorney, Agent, or Firm*—James A. Wong

[57] ABSTRACT

An aseismic system for structure foundations providing fluid between a structure foundation and the ground to eliminate any friction between the two, characterized by lateral chambers limited by flexible membranes positioned between a lower slab and retaining walls and foundation chambers also formed by perimetral membranes or bands between the lower slab and the foundation proper of the structure; these chambers being filled with a fluid through ducts, the fluid pressure being regulated by valves connected to a sensor.

7 Claims, 10 Drawing Figures

ASEISMIC SYSTEM FOR STRUCTURE FOUNDATION

BACKGROUND OF THE INVENTION

1. Field of the Invention

This invention relates to systems for use in preventing damage to structures in case of earthquake and, in particular, to an aseismic system for structure foundations.

2. Description of the Prior Art

According to statistics, an average of twenty-five severe earthquakes occur each year causing loss of lives and property. These areas in which earthquakes occur are known as "seismic zones" or "geological faults" and cover a large portion of the surface of the earth. Up to now man has not been able to control or arrest seismic activity, and for this reason it is imperative that buildings be constructed with such occurences in mind particularly in the "seismic zones." In this regard, there are two schools of thought, firstly, anti-seismic structures and, secondly, aseismic structures. In the case of anti-seismic structures, they are constructed to resist the horizontal forces that push it laterally during an earthquake. In the case of aseismic structures, they are not subject to these movements and thus do not require reinforcement to resist them.

Presently, there exists an aseismic system based on orthogonally positioned rollers which, by combining their displacements, permit the building to move in any direction. This system requires a double foundation: one to transmit the building loads to the rollers and the other to distribute the building loads to the ground. The loads must be concentrated because the two foundations must be tangential to the rollers.

SUMMARY OF THE INVENTION

According to the present invention, a system is disclosed as providing for fluid filled chambers between the foundation of the structure and the ground to eliminate any friction therebetween. In contrast to the roller system discussed above, the system according to the inventive concept does not require a double foundation in that it receives the load from the building through its foundation uniformly and the fluid receiving load distributes it equally uniformly into the ground. This transmission of loads will continue to be uniformly distributed even when the foundation of the structure or terrain undergoes displacements because the transmitting fluid equalizes the pressures and thus the thrusts in any direction regardless of the form they may take.

In the case of a differential or substantial sinking of the ground, as frequently occurs in the D. F. (Federal District of Mexico), the structure built on rollers slide on the rollers to the area of the sunken ground. When the system according to the disclosed invention is used, the movement of the structure to the sunken ground is avoided by increasing the quantity of fluid in the area of the sunken ground, whereby any sliding of the structure would be corrected, for example, by leveling valves.

Similarly, the roller system, because it comprises solid elements, will transmit the vertical vibrating motions directly to the foundation and thus will behave exactly like an anti-seismic structure. In the system of the present invention, because of the presence of a compressible fluid between the ground and the foundation, the effect of the quake is buffered and distributed as an increased load, not as an impact or shock.

In both the known system discussed above and in the system according to the present invention, the object is to eliminate the friction between the ground and the structure. In the known system discussed above, the object is achieved only partially since there are solid elements in contact; with the system of the present invention, the object in question is achieved completely as the displacement speeds produced by an earthquake are not sufficiently high so as to make the friction an important factor. The partial or total elimination of friction makes possible the displacement of the structure in any direction due to external forces such as winds, explosion waves, or the like. The system using rollers resolves this problem by means of solid buffers which, with the passage of time, lose their elasticity and will always produce the same reaction of the structure when there is a shifting or displacement of the ground produced by an earthquake or of the structure itself due to wind forces. In hurricane areas these winds will displace the structure to such an extent that the buffers are compressed, and the system will then cease to be an aseismic system, particularly when the structure and the ground are practically in contact. With the system of the present invention, the foregoing does not happen, particularly if enough fluid is injected so that the total pressure on the structure will be equal to that of the external forces and the structure will not undergo displacements regardless of the intensity of the forces acting upon it. Also, even when the ground suffers a displacement due to tremors and the fluid is compressed, the degree of compression would not be of such magnitude as to produce movements that would be perceptible to persons inside the structure.

BRIEF DESCRIPTION OF THE DRAWINGS

The various characteristics and advantages of the invention discussed above will be more readily appreciated by the reader upon consideration of the drawings in which.

DETAILED DESCRIPTION OF THE INVENTION

Figure 1:
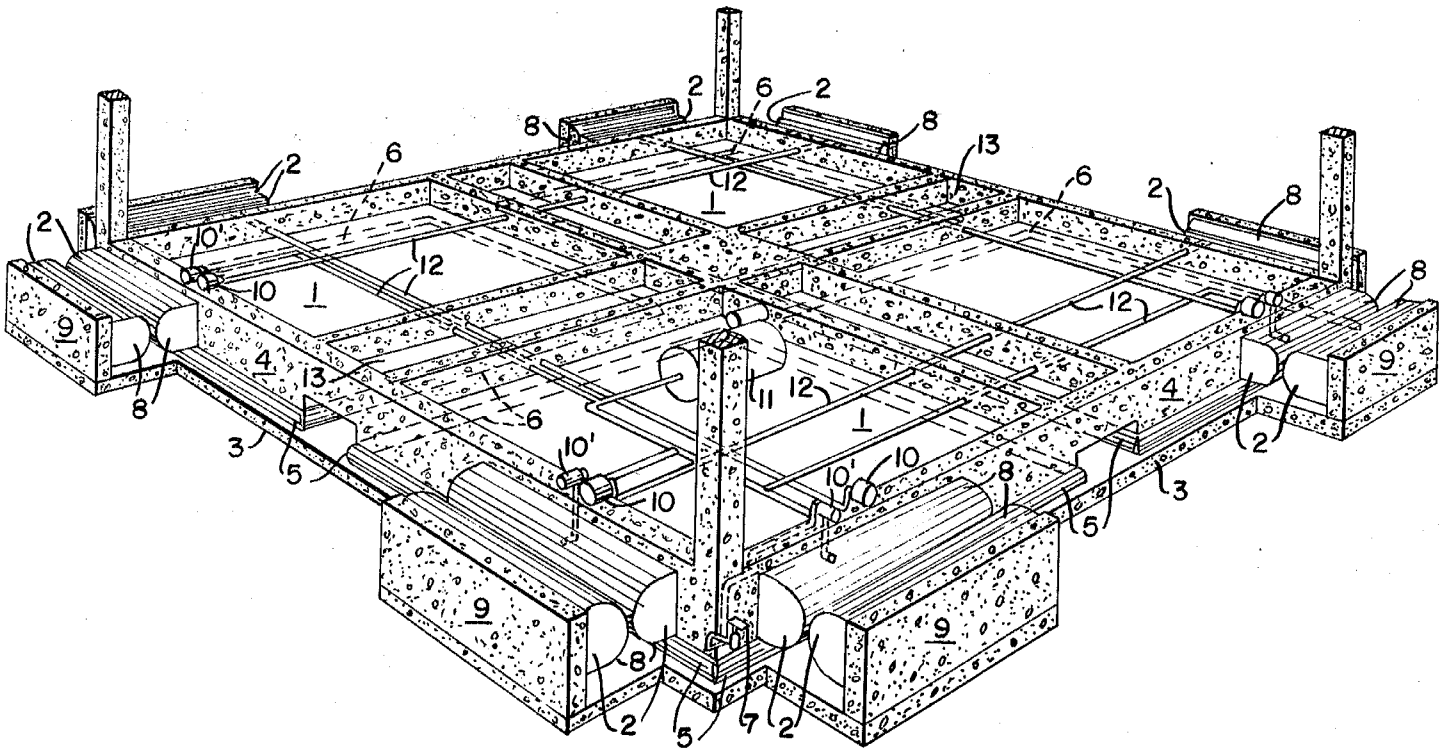
FIG. 1 is a schematic in perspective of the aseismic system according to the present invention as applied to a 4-column structure.

Referring now to FIGS. 1, 2A 2B, and 2C, the reader can readily see that the aseismic system according to the present invention comprises three basic elements: foundation chambers 1, lateral chambers 2, and accessories. The purpose of foundation chambers 1 is to provide fluid 14 between the foundation 4 of the structure and the ground to eliminate any friction therebetween so that the structure will not touch the ground and vibrations of the latter will thus not be transmitted to the structure. These foundation chambers 1 are made up of lower slab 3, which is a reinforced slab over the soil, and the purpose of which is to prevent any loss of fluid 14 through the natural soil. The amount of reinforcement provided will be calculated only to the extent of avoiding compression or dilation cracks or, should a greater margin of security be desired, to free the gap of a crack produced by a later tremor. The foundations 4 themselves can be of any type and do not require modification with the exception of leaving ducts 13 to position and replace, when necessary, lateral or perimetral bands 5. The purpose of the lateral bands 5 is to prevent the lateral escape of fluid 14 contained within foundation 4 and lower slab 3. Bands 5 may be of oilcloth, neoprene, plastic, or any other appropriate flexible material and will be attached to foundation 4 and lower slab 3. The projection 6 of the lateral bands 5 is represented in phantom in FIG. 1.

Figure 3A:
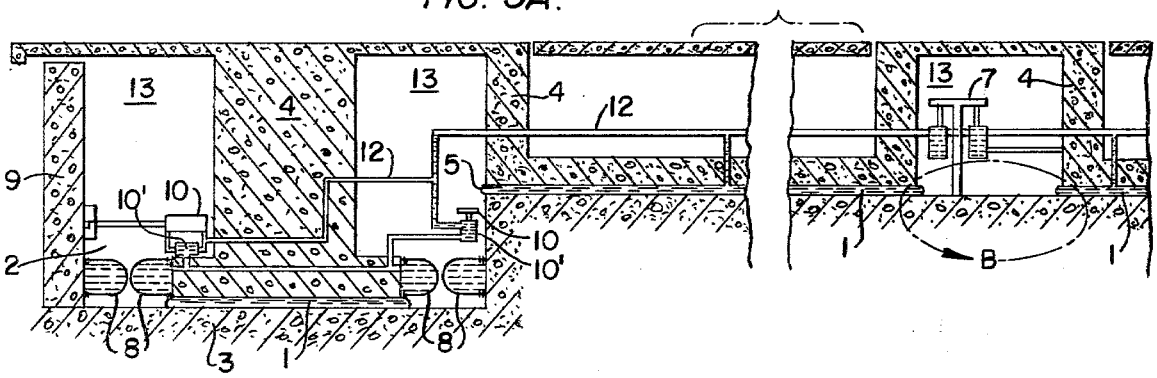
FIG. 3A represents a cross-sectional view on an enlarged scale taken through lines A-A' in FIG. 5.
Figure 3B:
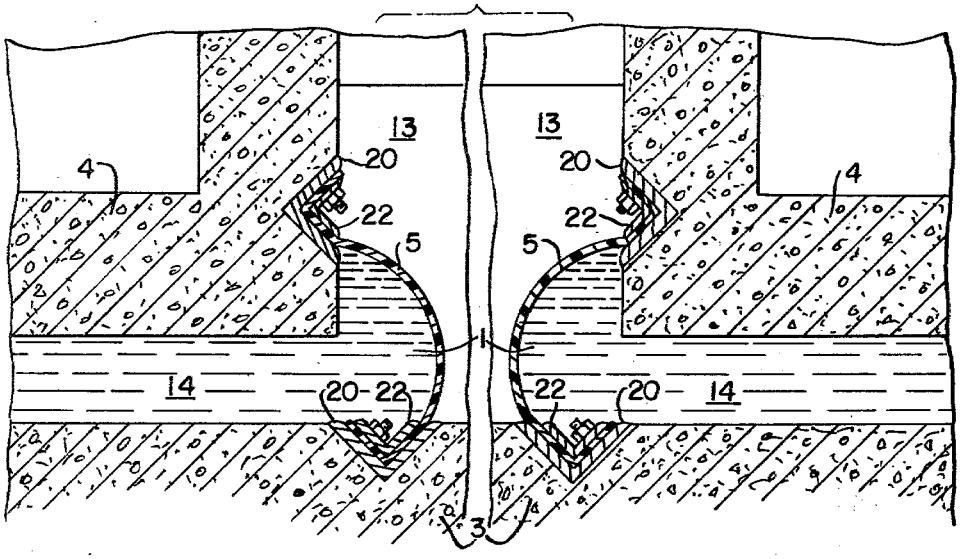
FIG. 3B is a view on an enlarged scale taken through section B-B' in FIG. 5.
Figure 3C:
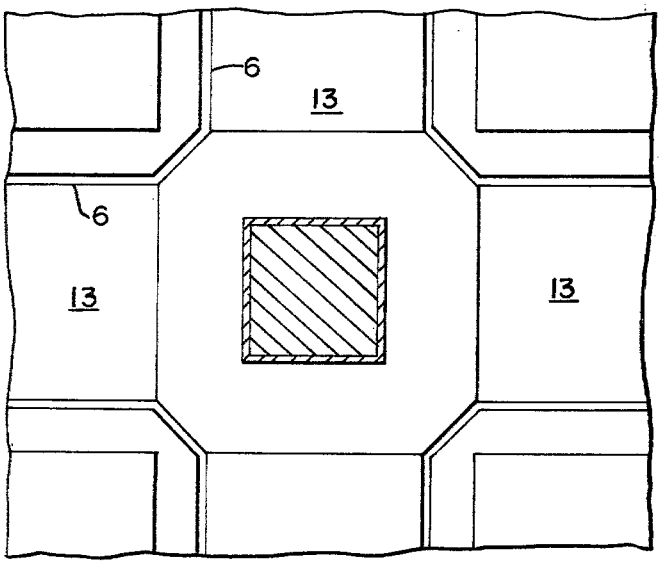
FIG. 3C is a detail of section C of FIG. 5 on an enlarged scale.

FIG. 3B shows the possible use of two structural angle irons 20, 22 that are screwed together and pressed against the two lateral bands 5 as attachment means therefor, which conveniently allows the replacement of bands 5 in case of damage thereof.

The purpose of fluid 14 is to eliminate friction between the ground and the structure, as stated previously. The fluid 14 may be a gas, a liquid, or any other gummy substance, which may be injected into chamber 1 when a compressor and a central tank 11 pushes it through tube 12 embedded in the foundation 4. When fluid 14 is introduced into chambers 1, the structure will rise until it has reached the required level. In addition to eliminating friction, the fluid 14 also uniformly transmits the vertical loads of the foundation 4 to lower slab 3 which, in turn, transmits them to the ground.

For a structure not to incline or tilt exceedingly from external forces, a minimum of three chambers in a triangular plan or four chambers in a rectangular plan are required, and positioned at 120° from each other in a triangular plan or 90° in a rectangular plan so that the reactions of these chambers when compressed form a resistant momentum equal to that caused by the external force.

When friction between the structure and the ground has been eliminated, any type of horizontal force, such as from winds, external explosions, or the like, tends to displace the structure. Consequently, it is necessary to provide reactions that will resist or nullify these forces, and this is the purpose of lateral chambers 2, which may contain a gas, liquid, or any other type of appropriate fluid 14 that can be compressed and injected to increase or decrease its pressure, as required. Fluid 14 will exert a uniform pressure in all directions equal to the atmospheric pressure if there is no external force that attempts to displace the structure, inasmuch as it is in contact with foundation 4 and the ground through a retaining wall 9 and will push towards both with equal intensity and in opposite directions. When the total push of the fluid 14 is equal to the displacement force, they nullify each other, and there is no movement on the part of the structure. At the same time, it is also necessary that the chambers 2 do not appreciably increase in pressure in the event that the ground or, for that matter, the retaining wall 9, should undergo displacement as a result of a seismic wave that compresses chambers 2 on one side and dilates chambers 2 on the other side as illustrated in FIGS. 2B and 2C. Also, chambers 2 must be positioned so that their combined force be in a direction opposite to that of the external force; in a triangular design structure they must be placed parallel to each of the sides, in a rectangular design two parallel to each pair of sides.

Figure 2A:
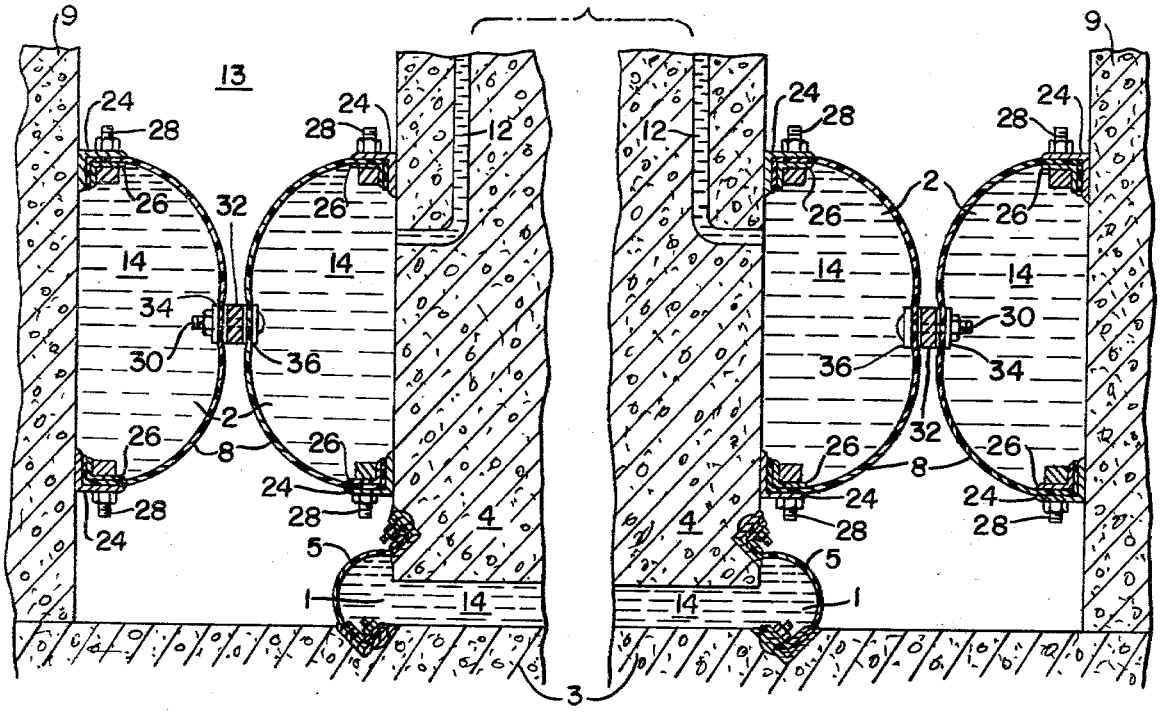
FIGS. 2A, 2B, and 2C represent a cross-sectional view of the lateral chambers in normal position and with possible movements towards one side or the other, respectively.
Figure 2B:
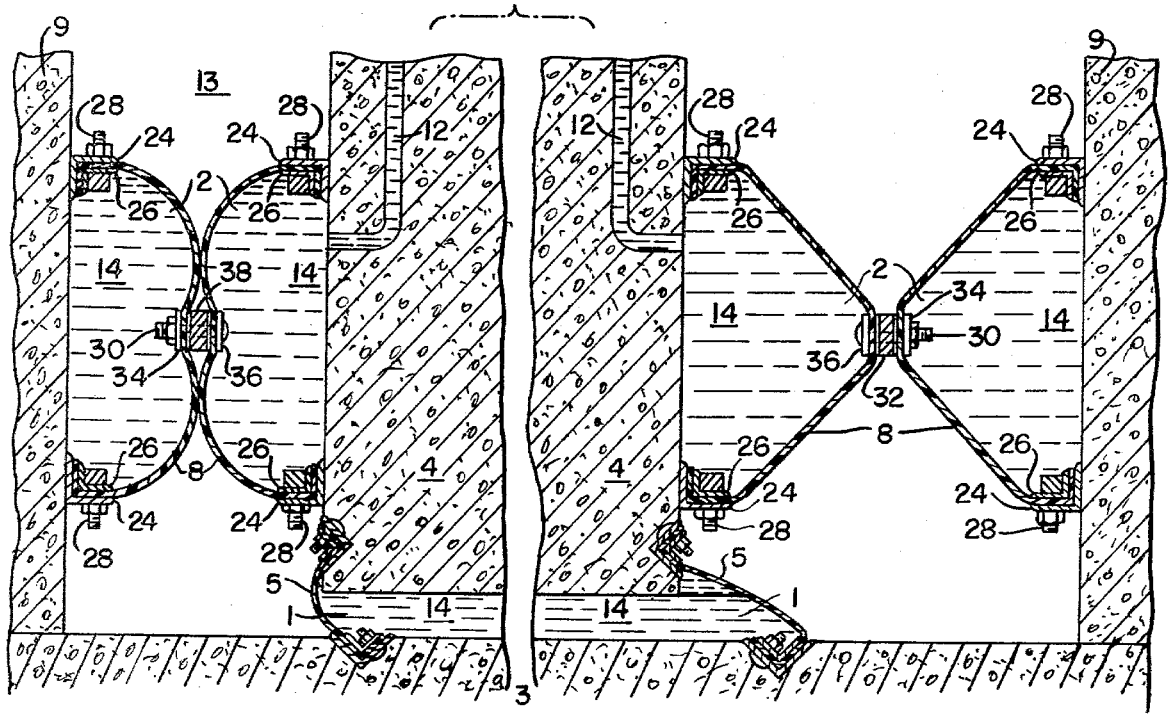
Figure 2C:
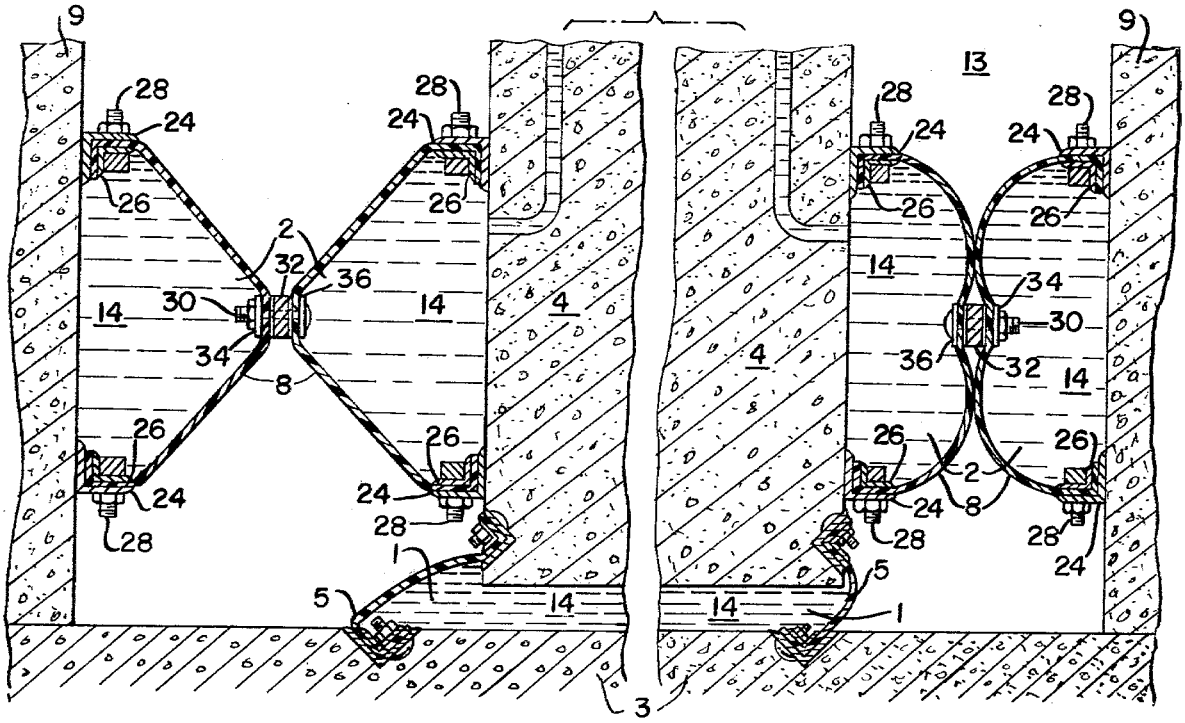
Figure 5:
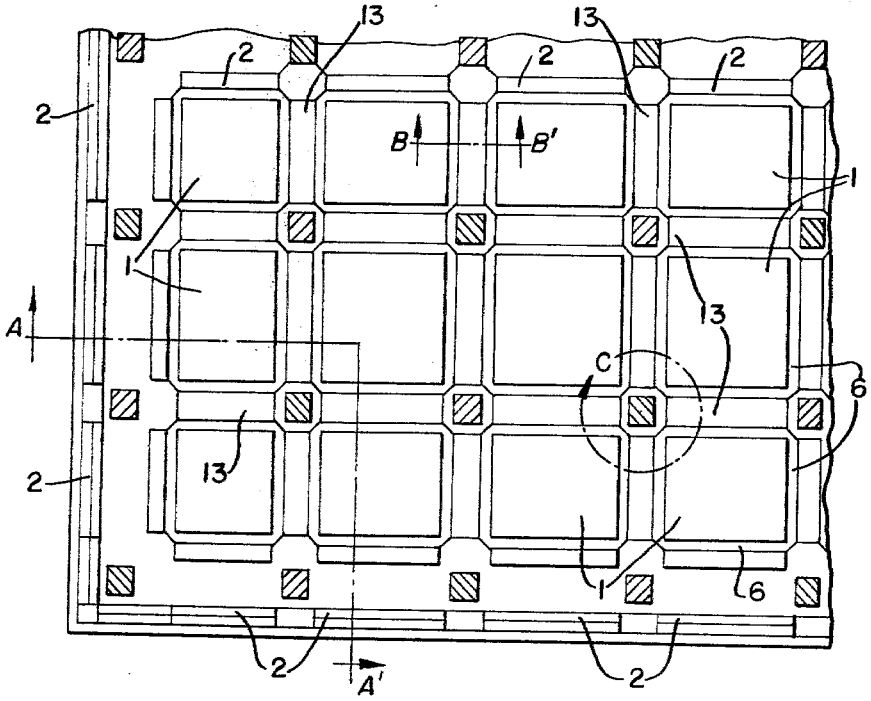
FIG. 5 represents a plan view of a structure with multiple columns and running slabs foundation.

FIG. 2A shows a possible solution whereby all the requirements of the lateral chamber 2 are fulfilled. Basically, they consist of two equal semicylindrical members crossed along the longitudinal axis. The level sides of each are formed by retaining wall 9 and foundation 4, respectively. The semicylindrical members are formed by two membranes 8 made of flexible material and tension resistant, neoprene, oilcloth, plastic, or the like. At each vertex, formed by two level and curved sides, there are structural angle irons 24, 26 attached to retaining wall 9 or to foundation 4, according to which it corresponds, and the free side has perforations to allow the passage of bolts 28. Its purpose is to ensure that with its counterpart the ends of membranes 8 press against each other by means of screws 30. At the center of the contact area of the two semicylindrical members, there will be three crossbeams: a central crossbeam 32 and two crossbeams 34, 36 on the interior sides of the membranes, joined together to confine them. Between each screw 30, there will be orifices leading to the two confined spaces so that fluid 14 contained within them remains at equal pressure that is so that the forces on the walls of the retaining wall 9 and foundation 4 will remain equal. In the space on the structure side, the fluid 14 will be injected or ejected through tubes 12. This operation will be regulated by a valve 10 that is capable of this double operation, namely, injection of fluid 14 to compress one lateral chamber 2 and ejection of fluid 14 from the opposite later chamber 2. This valve 10 is in turn activated by a movement sensor 10' which, upon detecting a horizontal movement of the structure in the normal direction of the chamber, will activate valve 10 to inject fluid 14 in the chamber 2 which is being compressed and eject fluid 14 from the chamber 2 which is dilating. The sensors 10' are positioned normally in the chambers 2 and will only detect longitudinal movements.

The accessories, as indicated by their name, are secondary elements and include a compressor with a reserve central tank 11, injection tube network 12, leveling valves 7, and revision ducts 13. The compressor can be of any type that is commercially available with its capacity being that required by the individual structure. The capacity of the reserve tank 11 is dictated by the reliability of the compressor, the duration of the winds, possible blackouts in the event that the structure does not have a plant of its own. There are two types of valves, leveling valves 7 in the foundation chambers 1 and injection-ejection valves 10 in lateral chambers 2; the function of the latter being to maintain the amount of fluid 14 required in the lateral chambers 2 so that the foundation 4 remains stable in relation to the ground. As may be readily appreciated in FIG. 2A, for example, lateral fluid chambers 2 are separate and distinct from the foundation fluid chambers 1.

Figure 4:
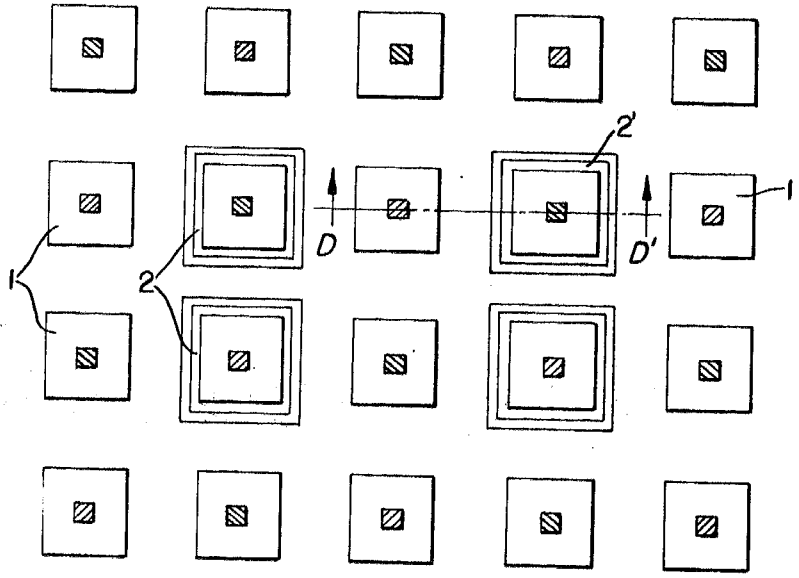
FIG. 4 represents a plan view of a structural design with isolated bolsters.
Figure 4A:
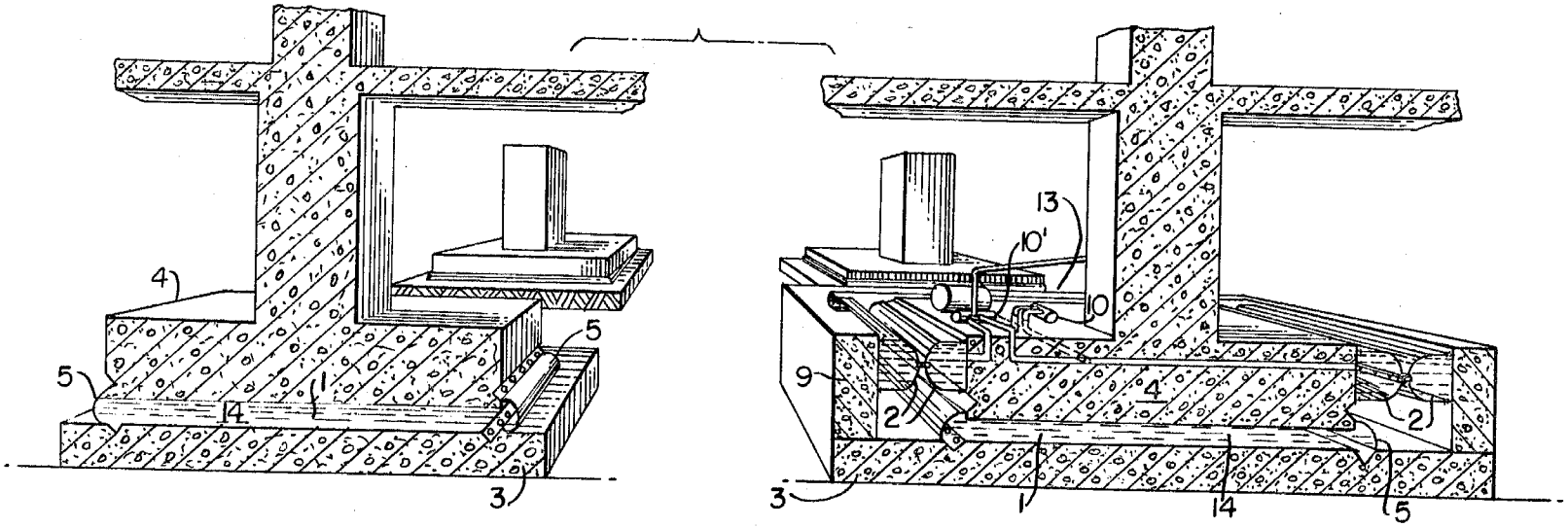
FIG. 4A is a sectional view in perspective of section D-D' in FIG. 4.

FIGS. 4 and 4A show examples of the application of the system to different foundation types; it may also be applied to pile and running shoe foundations. It is obvious that this system presents many advantages, both economic and psychological. Also, last but not least, definitely the greatest advantage of structures constructed with this system is that loss of human life due to earthquakes will be avoided.

It will be obvious to those skilled in the art that various changes may be made without departing from the scope of the invention and the invention is not to be considered limited to what is shown in the drawings and described in the specification.

What is claimed is:

1. An aseismic system comprising in combination:

a. a structure foundation;

b. a lower slab beneath said foundation with retaining walls extending upwardly therefrom along opposite sides of said foundation to isolate said foundation from the ground;

c. foundation fluid means disposed between said foundation and said lower slab;

d. lateral fluid means separate and distinct from said foundation fluid means disposed between said foundation and each of said retaining walls;

e. duct means for passage of fluid into and out of said foundation fluid means and said lateral fluid means;

f. first valve means for permitting fluid flow into said foundation fluid to effect leveling of said foundation;

g. second valve means for permitting fluid flow to and from said lateral fluid means thereby maintaining stability of said foundation with respect to the ground; and h. means for sensing horizontal movement tending to compress said lateral fluid means and in response thereto activating said second valve means to inject additional fluid to said lateral fluid means and for sensing horizontal movement tending to dilate said lateral fluid means and in response thereto activating said second valve means to eject fluid from said lateral fluid means.

2. An aseismic system comprising in combination:

a. a structure foundation;

b. a lower slab beneath said foundation with retaining walls extending upwardly therefrom along opposite sides of said foundation to isolate said foundation from the ground;

c. foundation fluid means disposed between said foundation and said lower slab;

d. lateral fluid means disposed between said foundation and each of said retaining walls;

e. duct means for passage of fluid into and out of said foundation fluid means and said lateral fluid means;

f. first valve means for permitting fluid flow into said foundation fluid to effect leveling of said foundation;

g. second valve means for permitting fluid flow to and from said lateral fluid means thereby maintaining stability of said foundation with respect to the grounds;

h. means for activating said second valve means to regulate pressure of said lateral fluid means in response to certain movement of said structure;

wherein said lateral fluid means comprise at least three pairs of fluid filled chambers each of which is formed from a flexible membrane.

3. The aseismic system as defined in claim 2, wherein each of said flexible membrane chambers is generally semicylindrical and include a screw extending therebetween facilitating a pressing relationship between said pair of chambers, said screw having at least one orifice extending therethrough whereby communication is established between said three pairs of chambers to maintain equal pressure therein so that the forces between the retaining wall structurally related therewith and the foundation may be kept equal.

4. The aseismic system as defined in claim 3, wherein said means for activating said second valve means comprise a sensor mechanism effective in detecting horizontal movement of said structure due to an earthquake particularly where such movement compresses one of said chambers and dilates the other of said chambers, and wherein said sensor mechanism upon detecting such movement will activate said second valve means to inject fluid into the chamber being compressed and to release fluid from the chamber being dilated.

5. An aseismic system comprising in combination:

a. a structure foundation;

b. a lower slab beneath said foundation with retaining walls extending upwardly therefrom along opposite sides of said foundation to isolate said foundation from the ground;

c. foundation fluid means disposed between said foundation and said lower slab;

d. lateral fluid means disposed between said foundation and each of said retaining walls;

e. duct means for passage of fluid into and out of said foundation fluid means and said lateral fluid means;

f. first valve means for permitting fluid flow into said foundation fluid to effect leveling of said foundation;

g. second valve means for permitting fluid flow to and from said lateral fluid means thereby maintaining stability of said foundation with respect to the ground;

h. means for activating said second valve means to regulate pressure of said lateral fluid means in response to certain movement of said structure;

wherein said foundation fluid means comprise a fluid filled perimetral band of flexible material.

6. The aseismic system as defined in any of said claims 4 or 5, wherein said system is formed in a triangular design including a minimum of three pairs of said fluid filled chambers.

7. The aseismic system as defined in any of said claims 4 or 5, wherein said system is formed in a rectangular design including a minimum of four pairs of said fluid filled chambers.

* * * * *